United States Patent [19]

Sato et al.

[11] Patent Number: 4,535,588

[45] Date of Patent: Aug. 20, 1985

[54] CARBON PARTICULATES CLEANING DEVICE FOR DIESEL ENGINE

[75] Inventors: Susumu Sato, Okazaki; Yukihisa Takeuchi, Aichi; Masahiro Tomita, Anjo, all of Japan

[73] Assignee: Nippon Soken, Inc., Nishio, Japan

[21] Appl. No.: 657,947

[22] Filed: Oct. 5, 1984

Related U.S. Application Data

[60] Division of Ser. No. 479,911, Mar. 28, 1983, abandoned, which is a continuation of Ser. No. 157,082, Jun. 6, 1980, abandoned.

[30] Foreign Application Priority Data

| | | | |
|---|---|---|---|
| Jun. 12, 1979 | [JP] | Japan | 54-74419 |
| Jul. 11, 1979 | [JP] | Japan | 54-88577 |
| Jul. 20, 1979 | [JP] | Japan | 54-92753 |
| Oct. 9, 1979 | [JP] | Japan | 54-130545 |
| Oct. 16, 1979 | [JP] | Japan | 54-133114 |
| Jan. 22, 1980 | [JP] | Japan | 55-6491 |

[51] Int. Cl.[3] ..... F01N 3/02

[52] U.S. Cl. ..... 60/286; 60/288; 60/297; 60/303; 60/311

[58] Field of Search ..... 60/274, 286, 297, 303, 60/311, 288

[56] References Cited

U.S. PATENT DOCUMENTS

| | | | |
|---|---|---|---|
| 2,898,202 | 8/1959 | Heudry | 60/297 |
| 3,499,269 | 3/1970 | Bois | 60/297 |
| 3,657,892 | 4/1972 | Perga | 60/288 |
| 4,211,075 | 7/1980 | Ludecke | 60/311 |
| 4,319,896 | 3/1982 | Sweeney | 60/311 |

FOREIGN PATENT DOCUMENTS

| | | | |
|---|---|---|---|
| 1216496 | 11/1959 | France | 60/288 |

*Primary Examiner*—Douglas Hart

*Attorney, Agent, or Firm*—Cushman, Darby & Cushman

[57] ABSTRACT

A carbon particulates cleaning device comprises a casing, a filter for catching and collecting carbon particulates included in the exhaust gas within the casing, an oxidizing catalyst carrier which is disposed within the casing and a fuel supply means for supplying the fuel into the interior of the casing. When the volume of the carbon particulates caught and collected by the filter reaches a predetermined volume, the fuel is supplied from the fuel supply means into the interior of the casing and burnt by the oxidization promoting action of the oxidizing catalyst. And the caught and collected carbon particulates are burnt and cleaned due to the burning heat of the fuel.

3 Claims, 10 Drawing Figures

CARBON PARTICULATES CLEANING DEVICE FOR DIESEL ENGINE

This is a division of application Ser. No. 479,911 filed Mar. 28, 1983, now abandoned, which is a continuation of Ser. No. 157,082, filed June 6, 1980, and now abandoned.

BACKGROUND OF THE PRESENT INVENTION

The present invention relates to a carbon particulates cleaning device for use in a diesel engine of an automobile or the like, which eliminates particulates mainly composed of carbon which are contained in an exhaust gas thereof.

According to the examples of the conventional carbon particulates cleaning device of such a type as described above, a filter or a cyclone separator is provided in an exhaust system of the engine for catching and collecting the particulates mainly composed of carbon (hereinafter will be called "carbon particulates'

According to another example, a means for catching and collecting carbon particulates is provided near an exhaust manifold for burning caught and collected carbon particulates due to the heat of an exhaust gas.

However, when the filter is used, it is clogged by carbon particulates. And when the cyclone is used, carbon particulates are not completely caught or collected since they are light and minute.

Furthermore, when the caught and collected carbon particulates are burnt due to the heat of the exhaust gas, high exhaust gas temperature not less than about 600° C. is required to burn the carbon particulates.

However, while the automobile is run on a street of a town, exhaust gas temperature thereof hardly rises to 600° C. Therefore, the caught and collected carbon particulates are not burnt while the automobile is run on a street of a town. As a result, the filter provided near the exhaust manifold is clogged by the caught and collected carbon particulates.

Accordingly, one object of the present invention is to provide a carbon particulates cleaning device by which carbon particulates caught and collected in a filter can be burnt and cleaned even when an automobile is run on a street of a town.

Another object of the present invention is to provide a carbon particulates cleaning device by which carbon particulates caught and collected in a filter can be burnt and cleaned in accordance with every operating conditions of an engine.

DESCRIPTION OF THE DRAWINGS

Other objects and advantages of the invention will become apparent from the following description of embodiments with reference to the accompanying drawings wherein.

DETAILED DESCRIPTION OF THE PRESENT INVENTION

The carbon particulates cleaning device of the present invention comprises a casing, a filter for catching and collecting carbon particulates included in the exhaust gas within the casing, an oxidizing catalyst carrier which is disposed within the casing and a fuel supply means for supplying the fuel into the interior of the casing.

According to the carbon particulates cleaning device of the present invention, the supplied fuel is oxidized and burnt at a temperature as low as about 300° C. due to the oxidation promoting action of the oxidizing catalyst. Therefore, according to the present invention, the caught and collected carbon particulates can be burnt and cleaned even when the temperature of the exhaust gas is below the spontaneous burning temperature of the carbon particulates, namely, below about 600° C.

As described above, according to the carbon particulates cleaning device of the present invention, carbon particulates are caught and collected and the caught and collected carbon particulates are burnt and cleaned at any exhaust gas temperature. And the filter and the like are not clogged by the carbon particulates so that the cleaning device of the present invention can be continuously used for a long period of time.

Furthermore, by providing a valve which opens or closes a fuel supplying passage which is communicated with the fuel injection means in accordance with the engine operating conditions, carbon particulates can be effectively burnt and cleaned by a small amount of fuel.

Hereinafter, the present invention will be explained in accordance with several embodiments with reference to the drawings.

Figure 1:
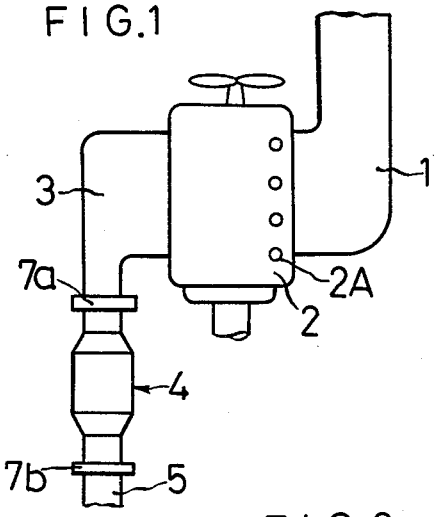
FIG. 1 is a view showing the attaching position of a carbon particulates cleaning device of the present invention in an exhaust system of a diesel engine.

In FIG. 1, reference numeral 1 designates an intake manifold, and reference numeral 2 designates a diesel engine. Fuel is supplied into the engine 2 from a well known fuel injection nozzle 2A.

A carbon particulates cleaning device 4 of the present invention is attached to the downstream end of an exhaust manifold 3 to collect and clean the carbon particulates contained in the exhaust gas which is discharged from the engine 2.

Reference numeral 5 designates an exhaust pipe.

Hereinafter, the carbon particulates cleaning device 4 will be explained in accordance with the embodiments from FIG. 2 to FIG. 8.

Figure 2:
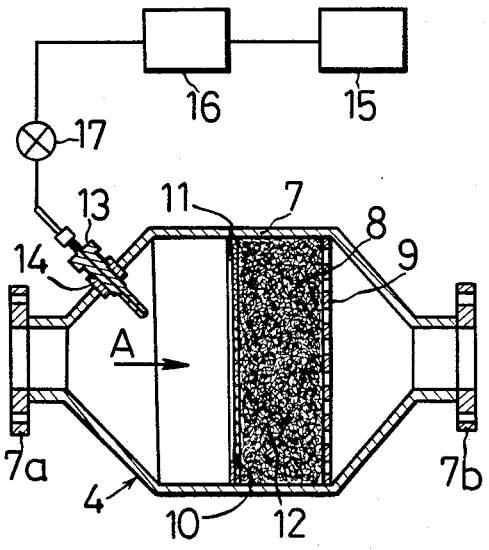
FIG. 2 is a longitudinal sectional view of a first embodiment of the present invention.

In the first embodiment as shown in FIG. 2, a cylindrical casing 7 is made of stainless steel. The cylindrical casing 7 is interposed between the exhaust manifold 3 and the exhaust pipe 5 by a flanges 7*a* and 7*b*. Exhaust gas is flowed in the direction as shown by an arrow A.

A filter 8 is made of glass wool and is disposed in the space between a punching metal 9 and a wire net 10. The punching metal 9 is made of stainless steel and is fixed to the casing 7 by spot-welding at the downstream side of the filter 8. The wire net 10 is made of stainless steel and fixed to the casing 7 by spot-welding through a ring stay 11 made of stainless steel at the upstream side of the filter 8. And the wire net 10 is about 100 mesh.

The filter 8 carries oxidizing catalyst 12 near the wire net 10. The filter 8 carrying the oxidizing catalyst is obtained by spraying a solution of chloroplatinic acid on the surface of the glass wool of the filter 8 and firing the surface at 500°~1000° C. for about 30 minutes, for example.

A fuel injection nozzle 13 is screwed to a fitting 14 which is welded into the casing 7. And the fuel injection nozzle 13 is communicated with a fuel tank 15 through a valve 17 and a fuel pump 16.

The valve 17 is interlocked with an accelerator pedal or a key switch (not shown). And when the engine is stopped or operated at a high load, the valve 17 is closed to stop the fuel supply into the fuel injection nozzle 13.

Hereinafter, the operation of the carbon particulates cleaning device 4 of the first embodiment will be explained.

Exhaust gas containing carbon particulates and the like is introduced into the cleaning device 4 from the diesel engine 2 through the exhaust manifold 3. And the carbon particulates are caught and collected in the portion of the filter 8 near the wire net 10.

Then, the valve 17 is opened to supply fuel from the fuel injection nozzle 13 to the upstream side of the filter 8. The supplied fuel is oxidized and burnt by the oxidization promoting action of the oxidizing catalyst 12. And the carbon particulates caught and collected by the filter 8 are also burnt and cleaned due to the burning heat of the fuel.

As described above, according to the carbon particulates cleaning device 4 of the first embodiment, the carbon particulates are burnt due to the heat which generates when the supplied fuel is burnt by the action of the oxidizing catalyst 12.

Therefore, the carbon particulates can be burnt and cleaned even when the temperature of the exhaust gas is below the temperature which is required to burn the carbon particulates (about 600° C.).

For example, even when the temperature of the exhaust gas is as low as about 300° C., the carbon particulates can be sufficiently burnt and cleaned.

Furthermore, the temperature of the exhaust gas which is discharged from the diesel engine can be raised by providing a throttle valve in the air intake system of the engine and throttling the valve. Therefore, by throttling the throttle valve to raise the temperature of the exhaust gas and supplying the fuel into the engine through the throttle valve, the carbon particulates can be purified over a wide range of engine conditions.

In the first embodiment, the filter made of glass wool is used. In addition, other material having heat-resistance and air-permeability, such as stainless steel wool, can be also used as the material of the filter.

And the platinum catalyst of the first embodiment can be replaced by other oxidizing catalysts. For example, palladium and rhodium catalyst can be used.

Furthermore, the fuel injection nozzle of the first embodiment can be replaced by other fuel injection means.

And any fuel can be used if it is burnt to generate heat by the action of the oxidizing catalyst. For example, the same fuel as that which is supplied to the engine 2 will do.

Figure 3:
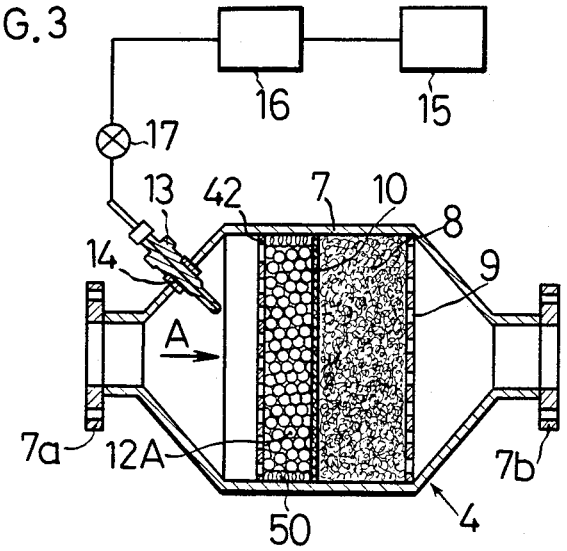
FIG. 3 is a longitudinal sectional view of a second embodiment of the present invention.

The second embodiment is shown in FIG. 3. At the upstream side of the filter 8, pellets 12A carrying an oxidizing catalyst are disposed. The pellets 12A are made of $\gamma$-alumina and have a diameter of 3 to 5 mm, respectively. The pellets 12A are charged between the punching metal 42 made of stainless steel and the wire net 10. The punching metal 42 and the wire net 10 are spot-welded to the casing 7. And the pellets 12A are retained by an elastic wire net 50 made of stainless steel surrounding the outer peripheral surface thereof.

The operation of the cleaning device of the second embodiment is substantially the same as that of the first embodiment.

Furthermore, in place of the pellets 12A, a ceramic honeycomb body carrying an oxidizing catalyst (about 200 mesh) can be used.

And alumina pellets or balls carrying an oxidizing catalyst, respectively, can be also used in place of the pellets 12A so as not to be contacted with each other within the filter 8.

The alumina pellets or balls which are disposed as described above are prevented from being broken even if the automobile or the like is vibrated.

Figure 4:
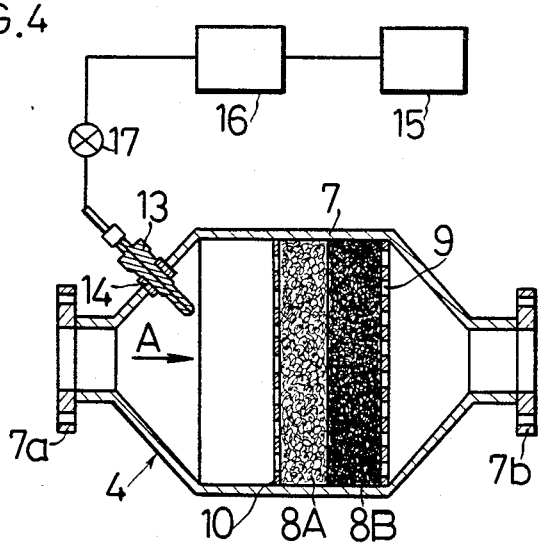
FIG. 4 is a longitudinal sectional view of a third embodiment of the present invention.

The third embodiment of the present invention is shown in FIG. 4.

The third embodiment is different from the first embodiment in that two kinds of filters 8A and 8B having different air-permeability with each other are used as a means for catching and collecting carbon particulates.

The filter 8A is positioned at the upstream side of the filter 8B. The filter 8A is made of stainless steel wool having a density of 0.3 to 1.0 gr/cm$^3$. And the diameter of each of stainless steel wool fibers is 0.3 mm.

The filter 8B is also made of stainless steel wool having a density of 1.0 to 2.5 gr/cm$^3$. The diameter of each of stainless steel wool fibers of the filter 8B is 0.1 mm.

Both filters 8A and 8B or only the filter 8A carry oxidizing catalyst containing platinum.

According to the carbon particulates cleaning device of the third embodiment, at first, carbon particulates having larger particle diameters are caught by the filter 8A having higher air-permeability, and next, the carbon particulates having smaller particle diameters, which passed through the filter 8A are caught by the filter 8B having lower air-permeability.

Therefore, the carbon particulates can be effectively caught by the filters 8A and 8B.

The means for catching and collecting carbon particulates of the third embodiment can be also composed of a plurality of filters made of ceramic foam or metal foam of which air-permeability are different from each other.

Figure 5:
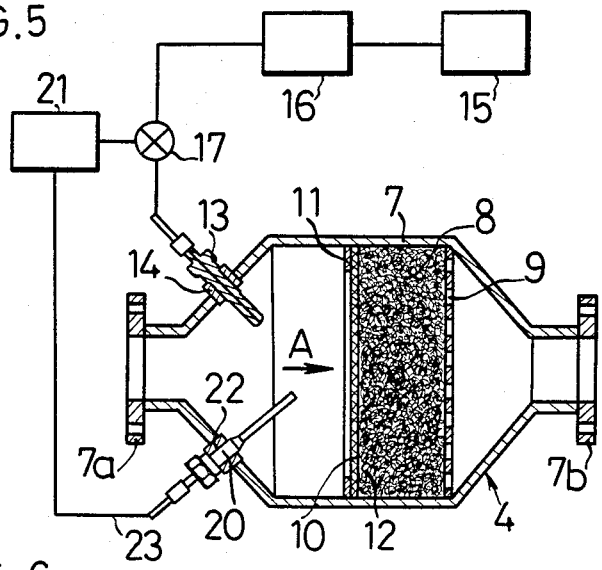
FIG. 5 is a longitudinal sectional view of a fourth embodiment of the present invention.

The fourth embodiment is shown in FIG. 5. The carbon particulates cleaning device of the fourth embodiment is provided with a temperature detecting means 20 for detecting the temperature of the exhaust gas, and a control circuit 21 for controlling the fuel supply in response to the temperature of the exhaust gas.

As the temperature detecting means 20, chromelalumel thermocouple is used, for example. The temperature detecting means 20 is disposed so that the temperature sensitive portion thereof is positioned at the upstream side of the filter 8 carrying oxidizing catalyst 12. And the temperature detecting means 20 is screwed into the fitting 22 which is welded to the casing 7.

The control circuit 21 is connected to the temperature detecting means 20 through a lead wire 23. And an electromagnetic valve 17 is opened or closed in response to the electric output from the temperature detecting means 20.

For example, when the output voltage of the temperature detecting means 20 is not less than a predetermined voltage, namely the temperature of the exhaust gas is not less than a predetermined temperature (about 600° C.), the electromagnetic valve 17 is closed. When the output voltage of the temperature detecting means 20 is below a predetermined voltage, the electromagnetic valve 17 is opened.

Therefore, the fuel is supplied from the fuel injection nozzle 13 only when the temperature of the exhaust gas is below 600° C. The fuel consumption can be reduced remarkably.

As the temperature detecting means 20, platinumrhodium thermocouple or thermister can be used.

Furthermore, the fuel supply can be also controlled by detecting the clogging condition of the filter 8. For example, two pipes for detecting the pressure within the casing 7 are provided at the upstream side and at the downstream side of the filter 8 within the casing 7. And these pipes are connected to a well known differential pressure detector, respectively.

The electromagnetic valve which is provided in the fuel passage communicated with the fuel injection nozzle is opened or closed in response to the electric output of the differential pressure detector.

The pressure difference between the upstream side of the filter 8 and the downstream side thereof is gradually increased as the volume of the caught and collected carbon particulates is increased. And the differential pressure detector makes the electromagnetic valve open to supply the fuel from the fuel injection nozzle into the interior of the cleaning device 4 when the pressure difference reaches a predetermined value (for example, 200 mmAg).

Then, the supplied fuel is oxidized and burnt by the action of the oxidizing catalyst carried by the filter 8. And also the carbon particulates caught by the filter 8 are burnt and cleaned due to the heat generating in the above described process.

After the carbon particulates are cleaned, the pressure difference between the upper stream of the filter 8 and the downstream thereof becomes small and the electromagnetic valve is closed to stop the fuel supply.

Thus, the fuel is supplied intermittently in response to the degree of clogging of the filter 8.

As a result, the fuel consumption can be remarkably decreased.

Furthermore, a flow detector which detects the flowing volume of the exhaust gas can be also provided in addition to the differential pressure detector. The pressure difference between the upstream of the filter 8 and the downstream side thereof is also changed due to the change of the flowing volume of the exhaust gas. By detecting the pressure difference wherein the change of the flowing volume of the exhaust gas is compensated, and controlling the opening and closing of the electromagnetic valve 17 thereby, the elctromagnetic valve 17 can be operated more precisely in response to the volume of the carbon particulates caught and collected by the filter 8.

Figure 6:
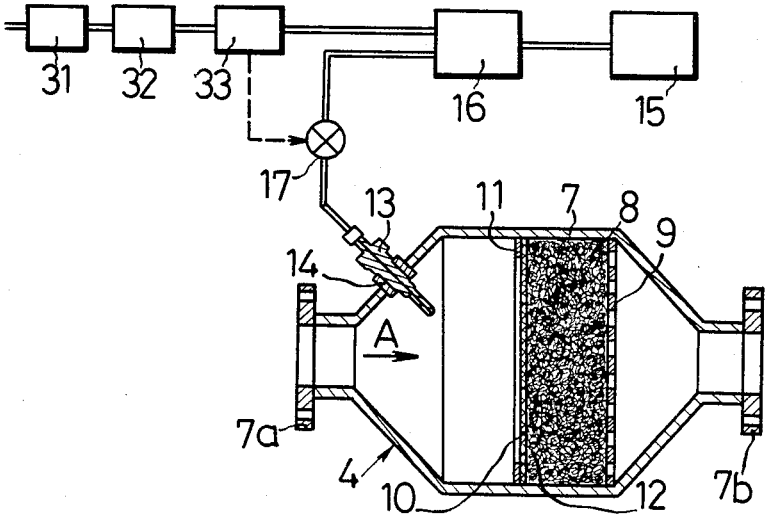
FIG. 6 is a longitudinal sectional view of a fifth embodiment of the present invention.

The fifth embodiment of the present invention is shown in FIG. 6. According to the fifth embodiment, the electromagnetic valve which is provided in the fuel supply passage communicated with the cleaning device is controlled in response to the fuel consumption of the engine.

The fuel injection nozzle 2A shown in FIG. 1, which supplies fuel into the engine 2 is communicated with the fuel pump 16 and the fuel tank 15 through a fuel injection pump 31, another fuel pump 32 and a fuel consumption detecting means 33. And the fuel consumption detecting means 33 is electrically connected with the electromagnetic valve 17. The fuel consumption detecting means 33 is of a float type, for example.

The float type fuel consumption detecting means 33 is provided with an electromagnetic valve (not shown) for controlling the fuel supply from the fuel tank 15 to the engine 2.

Whenever the float descends to a predetermined level, the electromagnetic valve as described above and the electromagnetic valve 17 which is provided in the fuel supply passage communicated with the cleaning device 4 are opened to supply the fuel into the float chamber and the cleaning device 4, respectively.

Then, the fuel is injected from the fuel injection nozzle 13 into the interior of the cleaning device 4. And the carbon particulates which are caught by the filter 8 are burnt and cleaned by the oxidation promoting action of the oxidizing catalyst 12.

The valve 17 is closed by a timer after a predetermined period of time which is required to burn the carbon particulates caught and collected by the filter 8.

Figure 7:
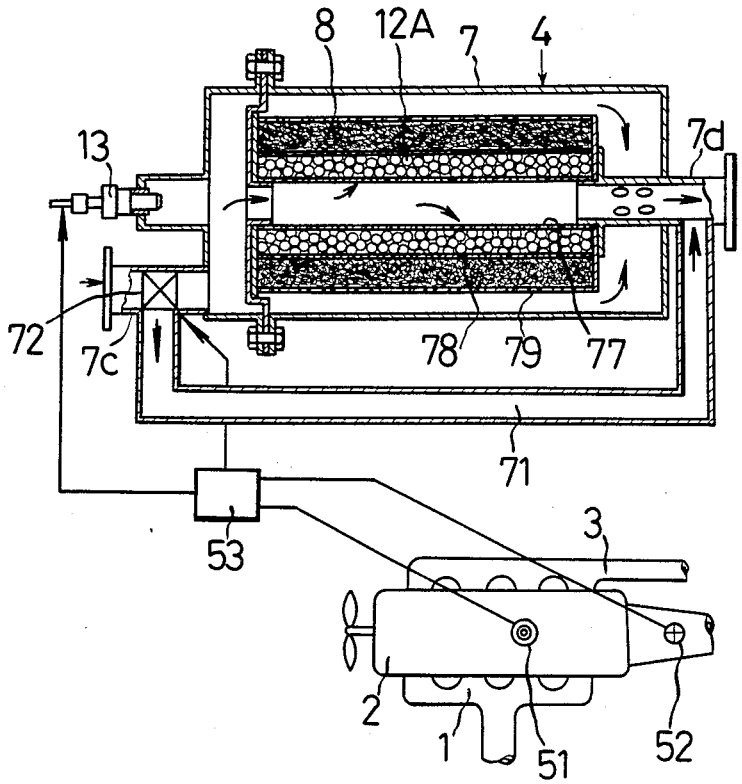
FIG. 7 is a longitudinal sectional view of a sixth embodiment of the present invention.

The sixth embodiment is shown in FIG. 7. In FIG. 7, an exhaust gas inlet pipe *7c* and an exhaust gas outlet pipe *7d* are connected with each other through a by-pass exhaust gas pipe 71 which is provided outside of the casing 7.

In the joining portion of the exhaust gas inlet pipe *7c* and the by-pass exhaust gas outlet pipe 71, is a selector valve 72 which selectively and alternately opens or closes the inlet to the casing and by-pass 71.

And the exhaust gas outlet pipe *7d* is provided with a large number of holes near the end of the casing 7 to be communicated with the interior of the casing 7. And the upstream end of the exhaust gas outlet pipe *7d* is closed.

The valve 72 and the valve (not shown) which is provided in the fuel supply passage communicated with the fuel injection nozzle 13 is controlled by a computer 53 which receives electric signals from an engine speed detecting means 51 and a torque detecting means 52.

When the engine speed and the engine torque are lower than a predetermined value and the density of the carbon particulates within the exhaust gas is low, the valve provided in the fuel supply passage is closed and the by-pass exhaust gas pipe 71 is communicated with the exhaust gas inlet pipe *7c*.

And when the engine speed and the engine torque are higher than a predetermined value, the valve provided in the fuel supply passage is opened and the exhaust gas inlet pipe *7c* is communicated with the inside of the casing 7, without being communicated with the by-pass exhaust gas pipe 71.

Within the casing 7, a cylindrical body composed of coaxial pipes 77, 78 and 79 is disposed. In the space between the pipe 77 and the pipe 78, alumina balls 12A which carry oxidizing catalyst are charged and in the space between the pipe 78 and the pipe 79, steel wool filter 8 is charged.

The exhaust gas is flowed from the pipe 77 to the exhaust gas outlet pipe *7d* radially outwardly through the alumina balls 12A and the steel wool filter 8.

Or the exhaust gas is flowed from the exhaust gas inlet pipe *7c* to the exhaust gas outlet pipe *7d* through the by-pass exhaust gas pipe 71.

According to the cleaning device of the sixth embodiment, only when the density of the carbon particulates within the exhaust gas is high, the particulates are caught and collected by the filter 8 and are burnt and cleaned.

Figure 8:
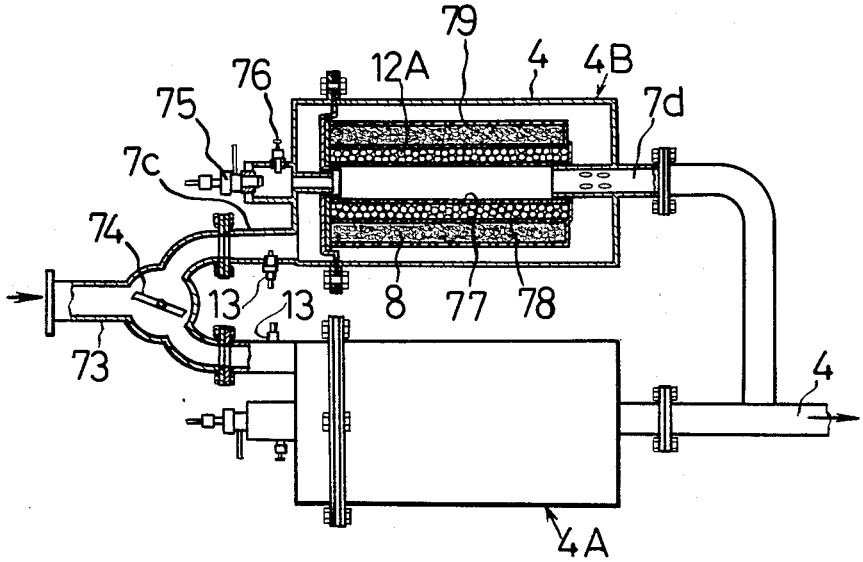
FIG. 8 is a longitudinal sectional view of a seventh embodiment of the present invention.

The seventh embodiment is shown in FIG. 8. In FIG. 8, the exhaust gas pipe 73 is diverged and in each of the diverged exhaust gas passages a carbon particulates cleaning device 4A or 4B is attached.

The carbon particulates cleaning devices 4A and 4B are of the same type as that of the cleaning device of the sixth embodiment.

The carbon particulates cleaning devices 4A and 4B of the seventh embodiment are further provided with an oil burner 75 and an ignition plug 76, respectively. And a means for detecting pressure difference between the upstream and the down stream sides of the filter 8 (not shown) is also added in each of the cleaning devices of the seventh embodiment.

And in the diverging point of the exhaust gas passage 73, a valve 74 is provided. The valve 74 is operated by an electromagnetic force to selectively open or close the diverged exhaust gas pipes which are communicated with the cleaning devices 4A and 4B, respectively.

The operation of the cleaning device of the seventh embodiment will be explained.

When the pressure difference within the cleaning device 4A reaches a predetermined value, the fuel is supplied from the fuel injection nozzle 13, and flame is supplied from the oil burner 75 into the cleaning device 4A.

At this time, the diverged exhaust gas inlet pipe *7c* which is communicated with the device 4A is closed by the valve 74 while the diverged exhaust gas passage which is communicated with the device 4B is opened. The fuel is flowed into the cleaning device 4B.

In the cleaning device 4A, the fuel is ignited by the flame supplied from the oil burner 75 and the carbon particulates which are caught and collected by the filter 8 are burnt and cleaned due to the burning heat of the fuel.

Then, in the cleaning device 4B, the volume of the carbon particulates caught and collected by the filter 8 is increased. And when the pressure difference within the cleaning device 4B reaches a predetermined value, the carbon particulates are burnt and cleaned in the same process as that of the device 4A.

In this stage, the exhaust gas is flowed only into the cleaning device 4A and is not flowed into the cleaning device 4B by the operation of the valve 74.

According to the cleaning device of the seventh embodiment, the carbon particulates can be burnt and cleaned even when the temperature of the exhaust gas is so low that the carbon particulates are not burnt even by the oxidation promoting action of the oxidizing catalyst 12A.

For example, even at a temperature below 300° C., the carbon particulates can be burnt and cleaned.

Furthermore, when the carbon particulates are burnt in one of the cleaning devices 4A and 4B, exhaust gas of which temperature is low, is not flowed therein so that the heating efficiency is not lowered.

The cleaning device 4 as shown in the above described embodiments can be also applied in the exhaust gas recirculation system by which a portion of the exhaust gas is recirculated into the intake system. By applying the cleaning device 4 in the exhaust gas recirculation system, the carbon particulates contained in the recirculated exhaust gas is eliminated to prevent the carbon particulates from attaching to a valve which is provided in the exhaust gas recirculation system.

Figure 9:
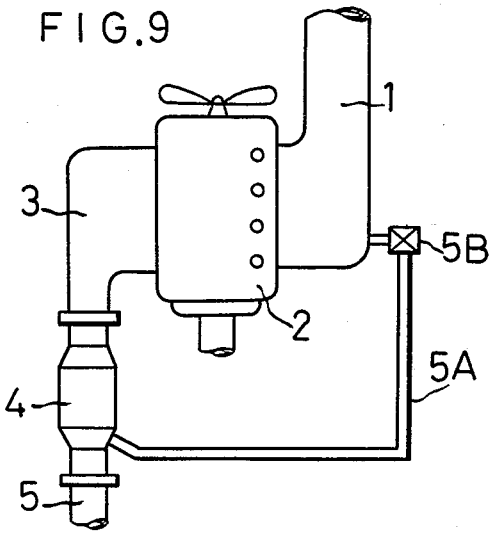
FIG. 9 is a view showing the attaching position of a carbon particulates cleaning device of the present invention in a diesel engine having an exhaust gas recirculation system.
Figure 10:
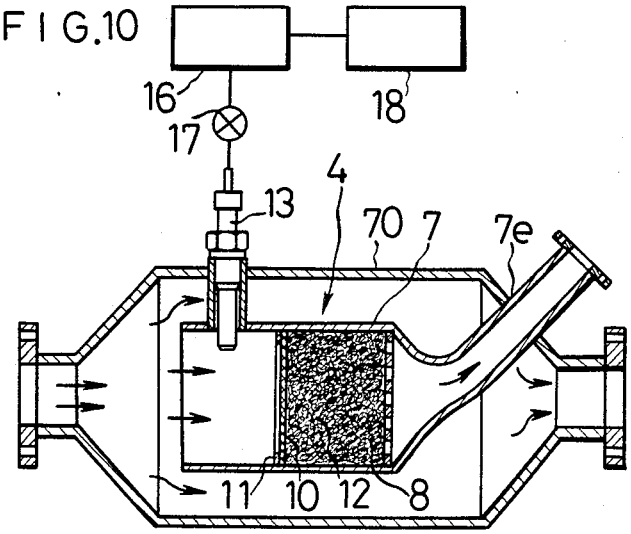
FIG. 10 is a longitudinal sectional view of a carbon particulates cleaning device of FIG. 9.

FIG. 9 shows the exhaust gas recirculation system, to which the cleaning device of the present invention is added.

The exhaust gas discharged from the engine 2 is supplied to the carbon particulates cleaning device 4 through an exhaust manifold 3. Most of the exhaust gas is flowed out through an exhaust pipe 5. A portion of the exhaust gas is cleaned and recirculated into an intake manifold 1 through an exhaust gas recirculation pipe 5A and a control valve 5B which controls the recirculation volume of the exhaust gas (hereinafter will be called "EGR valve").

The carbon particulates cleaning device 4 of the present embodiment has the same construction as that of the first embodiment shown in FIG. 2.

And the carbon particulates cleaning device 4 of the present embodiment is disposed within a casing 70 which composes a part of the exhaust gas passage. Exhaust gas outlet pipe *7e* penetrates the casing 70 and is communicated with the exhaust gas recirculation pipe 5A.

One portion of the exhaust gas is introduced into the cleaning device 4 and the carbon particulates contained within the exhaust gas are caught and collected by the filter 8.

The caught and collected carbon particulates are burnt and cleaned due to the heat which generates when the fuel is burnt by the oxidation promoting action of the oxidizing catalyst 12A. And the cleaned exhaust gas is supplied into the exhaust gas recirculation pipe 5A. As a result, the carbon particulates can be prevented from attaching to the EGR valve 5B.

Having now fully described several embodiments of the invention, it will be apparent to one of ordinary skill in the art that many additional changes and modifications can be made thereto without departing from the spirit or scope of the invention as set forth herein including the following claims.

What is claimed is:

1. A carbon particulates cleaning system for cleaning the carbon particulates contained in the exhaust gas discharged from an engine, comprising:

a casing adapted to be disposed in an exhaust gas passage of an engine and having an inlet pipe and an outlet pipe;

a by-pass pipe connected between said inlet pipe and said outlet pipe;

a valve disposed in a juncture portion of said inlet pipe and said by-pass pipe for closing one of them and opening the other;

a triple cylindrical body disposed in said casing and having three substantially coaxial cylindrical pipes for forming an inner and an outer annular space therein, both ends of said cylindrical body being closed and a central portion defined by an innermost pipe of said triple cylindrical body being communicated with said inlet pipe while an annular space defined by an outermost pipe of said triple cylindrical body and the innersurface of said casing being communicated with said outlet pipe;

fuel supply means attached to said casing for supplying fuel to said central portion;

oxidizing catalyst means disposed in said inner annular space;

filter means disposed in said outer annular space;

means for detecting operational conditions of said engine; and computer means for operating said valve and said fuel supply means in response to output signals from said detecting means.

2. A system for cleaning carbon particulates contained in exhaust gas discharged from an engine, comprising:

a carbon particulates cleaning device adapted to be connected to an exhaust pipe of an engine, said device including therein oxidizing catalyst and filter means for collecting carbon particulates contained in exhaust gas flowing into said device and for cleaning said exhaust gas;

a by-pass pipe for communicating an upstream end of said device with a downstream end thereof;

a valve disposed in said upstream side of said device for opening and closing said bypass pipe and correspondingly closing and opening the upstream end of said device;

fuel supply means attached to said device at said upstream end thereof for supplying fuel thereinto;

means for detecting operational conditions of said engine; and computer means for operating said valve and said fuel supply means in response to output signals from said detecting means.

3. A system according to claim 1 or 2, wherein said means for detecting operational conditions of said engine includes an engine speed detector and an engine torque detector.

* * * * *